US006719237B2

(12) United States Patent
Wohlfahrt et al.

(10) Patent No.: US 6,719,237 B2
(45) Date of Patent: Apr. 13, 2004

(54) PROCESS AND WINDING MACHINE FOR THE CONTINUOUS WINDING OF A MATERIAL WEB

(75) Inventors: Matthias Wohlfahrt, Heidenheim (DE); Roland Thomas, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/235,658

(22) Filed: Sep. 6, 2002

(65) Prior Publication Data

US 2003/0047640 A1 Mar. 13, 2003

(30) Foreign Application Priority Data

Sep. 7, 2001 (DE) ..... 101 44 016

(51) Int. Cl.[7] ..... B65H 18/16; B65H 18/26
(52) U.S. Cl. ..... 242/541.7; 242/542.3
(58) Field of Search ..... 242/542.3, 541.4, 242/541.5, 541.6, 541.7, 541.1

(56) References Cited

U.S. PATENT DOCUMENTS

| | | | |
|---|---|---|---|
| 5,273,222 | A | 12/1993 | Hutzenlaub et al. |
| 5,308,008 | A | 5/1994 | Rüegg |
| 5,370,327 | A | 12/1994 | Adamski |
| 5,690,298 | A | 11/1997 | Rück |
| 5,967,449 | A | 10/1999 | Thomas et al. |
| 6,129,305 | A | 10/2000 | Möller et al. |
| 6,250,580 | B1 | 6/2001 | Madrzak et al. |
| 6,390,408 | B1 | 5/2002 | Madrzak et al. |
| 6,550,713 | B1 * | 4/2003 | Ruha ..... 242/541.7 |

FOREIGN PATENT DOCUMENTS

| | | |
|---|---|---|
| DE | 4115863 | 11/1992 |
| DE | 4401959 | 7/1994 |
| DE | 697006 | 10/1996 |
| DE | 19745005 | 7/1998 |
| DE | 19735590 | 11/1998 |
| DE | 19807897 | 8/1999 |
| DE | 69508350 | 10/1999 |
| DE | 69507490 | 11/1999 |
| DE | 19923930 | 11/2000 |
| EP | 561128 | 9/1993 |
| EP | 697006 | 2/1996 |
| EP | 714373 | 6/1996 |
| EP | 776313 | 6/1997 |
| EP | 788991 | 8/1997 |
| EP | 1038815 | 9/2000 |
| WO | 9852858 | 11/1998 |

* cited by examiner

*Primary Examiner*—John M. Jillions
(74) *Attorney, Agent, or Firm*—Greenblum & Bernstein, P.L.C.

(57) ABSTRACT

Process and winding machine for winding a continuous material web on a reel spool forming a wound reel. The process includes, upon attaining a desired roll diameter in an old wound reel, closing a new winding nip between a reeling drum and a new reel spool brought into a standby position. In this regard, the reeling drum and the old wound reel are jointly displaced while maintaining the old winding nip formed between the reeling drum and the old wound reel. After the closing of the new winding nip between the reeling drum and the new reel spool, the linear load in the new winding nip is adjusted, controlled or regulated by a corresponding displacement and tightening of the reeling drum.

57 Claims, 4 Drawing Sheets

PROCESS AND WINDING MACHINE FOR THE CONTINUOUS WINDING OF A MATERIAL WEB

CROSS-REFERENCE TO RELATED APPLICATIONS

The present application claims priority under 35 U.S.C. §119 of German Patent Application No. 101 44 016.2, filed on Sep. 7, 2001, the disclosure of which is expressly incorporated by reference herein in its entirety.

BACKGROUND OF THE INVENTION

1. Field of the Invention

The invention relates to a process for the continuous winding of a material web, in particular a paper or cardboard web, onto a reel spool forming a wound reel.

The invention also relates to a winding machine for the continuous winding of a material web, in particular a paper or cardboard web, onto a reel spool forming a wound reel.

2. Discussion of Background Information

Processes and winding machines of this kind are disclosed, e.g., by printed publications WO 98/52858 A1, EP 0 788 991 B1, EP 0 561 128 A1 and EP 0 714 373 B1 .

For instance, with the process known from printed publication WO 98/52858, after the opening of the winding nip formed with the full wound reel, a squeezing element, such as, e.g., a squeeze roll or a pressing roll, has to be pressed against the wound reel to thus avoid the development of air inclusions between the individual layers of tie almost fully wound reel. Furthermore, the "wound up" web tension must be maintained, in order to thus guarantee the desired winding quality even in the outer area of the wound reel. The problem that thereby arises increases the faster the winding machine is operated (magnitude 1,500–2,500 m/min) and the larger the diameters produced in the finished reel spools (magnitude 2.5–4 m).

SUMMARY OF THE INVENTION

The present invention provides an improved process and an improved winding machine of the types mentioned at the outset, with which the above-noted disadvantage is eliminated.

According to the invention, the process mentioned at the outset for winding a material web, e.g., a paper or cardboard web, on a reel spool forming a wound reel includes closing the new winding nip between the reeling drum and the new reel spool brought into a standby position, the reeling drum and the old wound reel are jointly displaced while maintaining the old winding nip formed between the reeling drum and the old wound reel, and that, after the closing of the new winding nip between the reeling drum and the new reel spool, the linear load in the new winding nip is adjusted, controlled or regulated by a corresponding displacement and tightening of the reeling drum.

On the basis of this embodiment, two winding nips can be temporarily formed at the same time in the phase of a turn-up and web change while maintaining preferably adjusted, controlled or regulated linear loads to achieve good winding qualities on the old winding reel and on the new reel spool, through which a change is rendered possible without a squeezing element. The following advantages, among others, of the process described, e.g., in the printed publication WO 98/52858 A1, are thereby maintained:

No linear load transfer due to the linear load generation through the reeling drum;

Smaller linear loads can be realized; and

A simple attachment of center drives to primary and secondary carriages is possible due to the path control.

Even with more sensitive papers, broke no longer occurs on the outer layers. Compared with the so-called Pope reel, at least essentially the same advantages result compared with die process known from printed publication WO 98/52858 A1.

In order to maintain a good winding quality up to the last layer on the old wound reel, it is provided according to the invention that during the joint displacement of the reeling drum and the old wound reel, the linear load in the old winding nip is adjusted controlled or regulated by a corresponding displacement and tightening of the old wound reel.

For the purpose of the displacement of the reeling drum and the old wound reel while maintaining the old winding nip formed, it is provided for the reeling drum to be acted on by a force that is greater than a force acting on the old wound reel.

Alternatively, it is provided for the old wound reel to be acted on by a pressure system generating the linear load, which pressure system features at least two pressure units, preferably independent of one another. In this manner, each of these pressure units can be acted on by a respective force to generate the linear load. The old wound reel will thereby be acted on by a force generating the linear load, which force is smaller than a force acting on the reeling drum, and/or the old wound reel is acted on by a force generating the linear load, which force is smaller than a force acting on the reeling drum. In both cases, the joint displacement of the reeling drum and the old wound reel is brought about while maintaining the old winding nip formed.

The increase in diameter of the old wound reel during the joint displacement of the reeling drum and the old wound reel while maintaining the old winding nip formed is compensated for by a corresponding displacement of at least one pressure unit, whereby technological and economical advantages are obtained with this type of compensation.

In order that the linear load in the winding nip between the reeling drum and the old wound reel can be adjusted, controlled or regulated precisely and quickly during the so-called main winding phase, the old wound reel, supported by a displaceable movement unit, acted on by the second pressure unit in the displaceable secondary transport device acted on by the first pressure unit, is acted on by a force such that it is supported in the secondary transport device in a stationary manner. It is thereby preferably pressed against a stationary stop by the acting force, which stop can be preferably a mechanical stop mounted on the secondary installation or an end stop of a cylinder.

In order to avoid possible damage to the material web and to the winding machine, the force acting on the reeling drum is restricted to a maximum, adjustable limit value.

During the closing of the new winding nip between the reeling drum and the new reel spool, the force acting on the reeling drum reaches the maximum, adjustable limit value, and subsequently the force ($K_{TT}$) is divided vectorially to generate a linear load ($LK_{PrimNip}$) in the new winding nip(22').

From practical viewpoints it is advantageous if the forces are generated hydraulically and/or pneumatically and adjusted, controlled or regulated by at least one pressure control on the reeling drum and/or on the secondary transport device, preferably using Servo-p-Q proportional valves. The forces are preferably generated by at least one linear load control, which preferably features at least one load cell. Alternatively or additionally, the forces can also be adjusted, controlled or regulated by the use of pressure proportional valves. The forces can also be generated by mechanical, hydraulic, pneumatic or electrical components.

The increase in diameter of the old wound reel displaceable by the secondary transport device is preferably compensated by a corresponding displacement of the old wound reel.

According to a preferred practical embodiment of the process according to the invention, for the control or regulation of the linear load in the old winding nip during the main winding phase by a corresponding displacement and adjustment of the old wound reel during the joint displacement of the reeling drum and the old wound reel, regarding the old wound reel, a power control is provided with a lift of approx. 50 to approx. 400 mm, preferably approx. 80 to approx. 120 mm.

The new reel spool can be displaced, preferably swiveled, in particular from a higher position to a lower position, by the primary transport device;

A preferred practical embodiment of the process according to the invention is distinguished by the fact that the primary transport device comprises mandrels and the new reel spool is displaced or swiveled by these mandrels, which rules out the possibility of an interlacing with the old wound reel.

A preferred exemplary embodiment of the process according to the invention is also distinguished by the fact that the secondary transport device comprises mandrels, and the old wound reel is displaced by the mandrels.

The old wound reel is preferably displaced by the secondary transport device at least essentially in a horizontal manner.

Expediently, the reeling drum is also preferably displaceable in a horizontal manner.

According to all expedient, practical embodiment, the new reel spool is brought into a stand-by position at an oblique angle above the reeling drum in its preferably horizontal sliding path and, during the production of the new winding nip, is pressed against the reeling drum by a preferably horizontal displacement of the reeling drum such that a preset linear load is established in the new winding nip.

The increase in diameter of the new wound reel occurring during the displacement of the new reel spool by the primary transport device is preferably compensated for by a corresponding, in particular horizontal, displacement of the reeling drum It is also advantageous if the linear load in the new winding nip is at least essentially stabilized during the displacement of the new reel spool by the primary transport device.

The direction of the joint displacement of the reeling drum and the old wound reel preferably has at least one directional component in the direction of the path of motion of the secondary transport device.

The present invention is directed to a winding machine mentioned at the outset for winding a material web, e.g., a paper or cardboard web, on a reel spool forming a wound reel. The winding machine includes a closable new winding nip between the reeling drum and the new reel spool brought into a stand-by position, the reeling drum and the old wound reel are jointly displaceable while maintaining the old winding nip formed between the reeling drum and the old wound reel, and that, after closing the new winding nip between the reeling drum and the new reel spool, the linear load in the new winding nip can be controlled or regulated by a corresponding displacement and tightening of the reeling drum.

Preferred embodiments of the winding machine according to the invention are given in the dependent claims.

The present invention is directed to a process for winding a continuous material web on a reel spool forming a wound reel. The process includes forming a winding nip between a displaceable reeling drum and an old wound reel, which is displaceably mounted in a secondary transport device, adjusting, controlling or regulating a linear load ($LK_{SekNip}$) in the winding nip by a corresponding displacement and tightening of the reeling drum, and guiding the material web over the displaceable reeling drum that, with the old wound reel displaceable by a secondary transport device, forms a winding nip. The process also includes bringing a new reel spool into a stand-by position, jointly moving the reeling drum and the old wound reel while maintaining the winding nip formed between the reeling drum and the old wound reel when the old wound reel attains a preset diameter whereby a new winding nip is formed between the new reel spool in the stand-by position and the reeling drum, and adjusting, controlling, or regulating a linear load ($LK_{PrimNip}$) in the new winding nip by a corresponding displacement and tightening of the reeling drum. The process further includes separating the material web by at least one separator device to form a new web leader, winding the new web leader onto the new reel spool, removing the old wound reel from the reeling drum, thereby opening the winding nip, and moving the new reel spool in a primary transport device while maintaining the new winding nip until the position of the new winding nip corresponds to the position where the winding nip was located.

According to a feature of the invention, the material web can include one of a paper or cardboard web.

In accordance with another feature of the invention, the moving of the new reel spool may include moving the new reel spool over the reeling drum via the primary transport device until the new reel spool is taken over by the secondary transport device.

In accordance with still another feature, the removing of the old wound reel can include moving the old wound reel via the secondary transport device.

During the joint displacement of the reeling drum and the old wound reel, the process may further include adjusting, controlling, or regulating the linear load ($LK_{SekNip}$) in the old winding nip by a corresponding displacement and tightening of the old wound reel.

The reeling drum can be acted on by a force ($K_{TT}$) generating the linear load ($LK_{SekNip}$), and the force ($K_{TT}$) may be greater than a force ($K_{SekSchl}$) acting on the old wound reel and cause the joint displacement of the reeling drum and the old wound reel while maintaining the old winding nip.

Moreover, the old wound reel may be acted on by a pressure system generating the linear load ($LK_{SekNip}$), and the pressure system can include at least two pressure units arranged such that each of the pressure units can be acted on by a respective force ($K_{SekSchl}$, $K_{SekSchl\text{-}II}$) to generate the linear load ($LK_{SekNip}$). The at least two pressure units may be independent of one, another. Further, the old wound reel can be acted on by a force ($K_{SekSchl}$) generating the linear load ($LK_{SekNip}$), and the force ($K_{SekSchl}$) may be smaller than a force ($K_{TT}$) acting on the reeling drum and cause the joint displacement of the reeling drum and the old wound reel while maintaining the old winding nip. The old wound reel may be acted on by a force ($K_{SekSchl\text{-}II}$) generating the linear load ($LK_{SekNip}$), and the force ($K_{SekSchl\text{-}II}$) can be smaller than a force ($K_{TT}$) acting on the reeling drum and cause the joint displacement of the reeling drum and the old wound reel while maintaining the old winding nip. The diameter of the old wound reel increases during the joint displacement of the reeling drum and the old wound reel, while maintaining the old winding nip, can be compensated for by a corresponding displacement of at least one pressure unit. The at least two pressure units can include a first and second pressure unit, and the old wound reel can be supported by a displaceable movement device acted on by the second pressure unit in the secondary transport device, and the secondary transport device can be acted on by the first pressure unit, and the old wound reel may be acted on by the force ($K_{SekSchl-II}$) during a main winding phase in which it is supported in the secondary transport device in a stationary manner.

According to a further feature of the invention, a force ($K_{TT}$) acting on the reeling drum can be limited by a maximum, adjustable limit value ($K_{TTmax}$). When the new winding nip between the reeling drum anti the new reel spool is closed, the force ($K_{TT}$) acting on the reeling drum can reach the a maximum adjustable limit value ($K_{TTmax}$) and, subsequently, the force ($K_{TT}$) may be vectorially divided to generate a linear load ($LK_{PrimNip}$) in the new winding nip. The forces ($K_{TT}$, $K_{SekSchl}$, $K_{SekSchl-II}$) can be generated at least one of hydraulically and pneumatically and the forces may be adjusted, controlled or regulated by at least one pressure control on at least one of the reeling drum, the secondary transport device, and the movement device. The at least one pressure control can include Servo-p-Q proportional valves. The forces ($K_{TT}$, $K_{SekSchl}$, $K_{SekSchl-II}$) may be generated, controlled or regulated by at least one linear load control that includes at least one load cell. The forces ($K_{TT}$, $K_{SekSchl}$, $K_{SekSchl-II}$) can be adjusted, controlled or regulated by pressure proportional valves. The forces ($K_{TT}$, $K_{SekSchl}$, $K_{SekSchl-II}$) may be generated by mechanical, hydraulic, pneumatic or electrical components.

In accordance with another feature of the invention, an increase in diameter of the old wound reel can be compensated for during a main winding phase by a corresponding displacement of the old wound reel.

To control or regulate the linear load ($LK_{SekNip}$) in the old winding nip during a main winding phase by the corresponding displacement and tightening of the old wound reel during the joint displacement of the reeling drum and the old wound reel, a power control can lift the old winding reel between about 50–400 mm. Further, the power control may lift the old wound reel between about 80–120 mm.

The new reel spool may be moved from a higher position to a lower position by the primary transport device. Further, the primary transport device can swivelably move the new reel spool.

The primary transport device can include mandrels, and the new reel spool may be displaced or swivelled by the mandrels.

The old wound reel may be displaced at least essentially horizontally by the secondary transport device.

Further, the secondary transport device can include mandrels and the old wound reel may be displaced by the mandrels.

Still further, the reeling drum may be displaced horizontally.

According to still another feature of the present invention, the stand-by position can be located at an oblique angle above the reeling drum, and when the new winding nip is closed, reeling drum may be pressed against the new reel spool in the stand-by position by a horizontally moving the reeling drum so that a preset linear load ($LK_{PrimNip}$) is established in the new winding nip.

The increasing diameter of the new wound reel occurring during the displacement of the new reel spool by the primary transport device can be compensated for by a corresponding, displacement of the reeling drum.

In accordance with a further feature, linear load ($LK_{PrimNip}$) in the new winding nip can be stabilized at least essentially during the displacement of the new reel spool by the primary transport device.

Moreover, a direction of the joint movement of the reeling drum and the old wound reel can have at least one directional component in the direction of movement of the secondary transport device.

The present invention is directed to a winding machine for the continuous winding of a material web on a reel spool forming a wound reel. The machine includes a displaceable reeling drum having a circumferential area structured to receive the material web and a secondary transport device structured and arranged to displace an old wound reel. The reeling drum and the old wound reel are arranged to form a winding nip and a linear load ($LK_{SekNip}$) in the winding nip is controlled or regulated by a corresponding displacement and tightening of the reeling drum. A device locating a new reel spool into a stand-by position is provided, such that, when a preset wound reel diameter is attained, the reeling drum and the old wound reel are structured and arranged to jointly move toward the stand-by position, while maintaining the winding nip, to form a new winding nip between the new reel spool and the reeling drum. At least one web separating device is structured and arranged to separate the material web and to form a new web leader, and the secondary transport device is movable to open the winding nip and to move the old wound reel away from the reeling drum. A primary transport device is structured and arranged to move the new reel spool from the stand-by position to a position at which the winding nip was located while maintaining the new winding nip, such that a linear load ($LK_{PrimNip}$) in the new winding nip is adjustable, controllable or regulatable by a corresponding displacement and tightening of the reeling drum.

According to a feature of the invention, the primary transport device may be structured and arranged to move the new reel spool over the reeling drum until it is taken over by the secondary transport device.

In accordance with another feature, during the joint displacement of the reeling drum and the old wound reel, the linear load ($LK_{SekNiP}$) in the old winding nip can be adjustable, controllable, or regulatable by a corresponding displacement and tightening of the old wound reel.

The winding machine can further include at least one pressure unit, such that an increasing diameter of the old wound reel in joint movement with the reeling drum can be compensated by a corresponding displacement of the least one pressure unit.

The winding machine may also include at least one linear load control having at least one load cell structured and arranged to adjust, control or regulate the forces ($K_{TT}$, $K_{SekSchl}$, $K_{SekSchl-II}$).

In accordance with still yet another feature of the instant invention, to control or regulate the linear load ($LK_{SekNip}$) in the old winding nip by a corresponding displacement and tightening of the old wound reel during the joint movement of the reeling drum and the old wound reel, a power control may be structured and arranged to provide a lift of between about 50–400 mm. Further, the power control can be structured and arranged to provide a lift of between about 80–120 mm.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are present in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
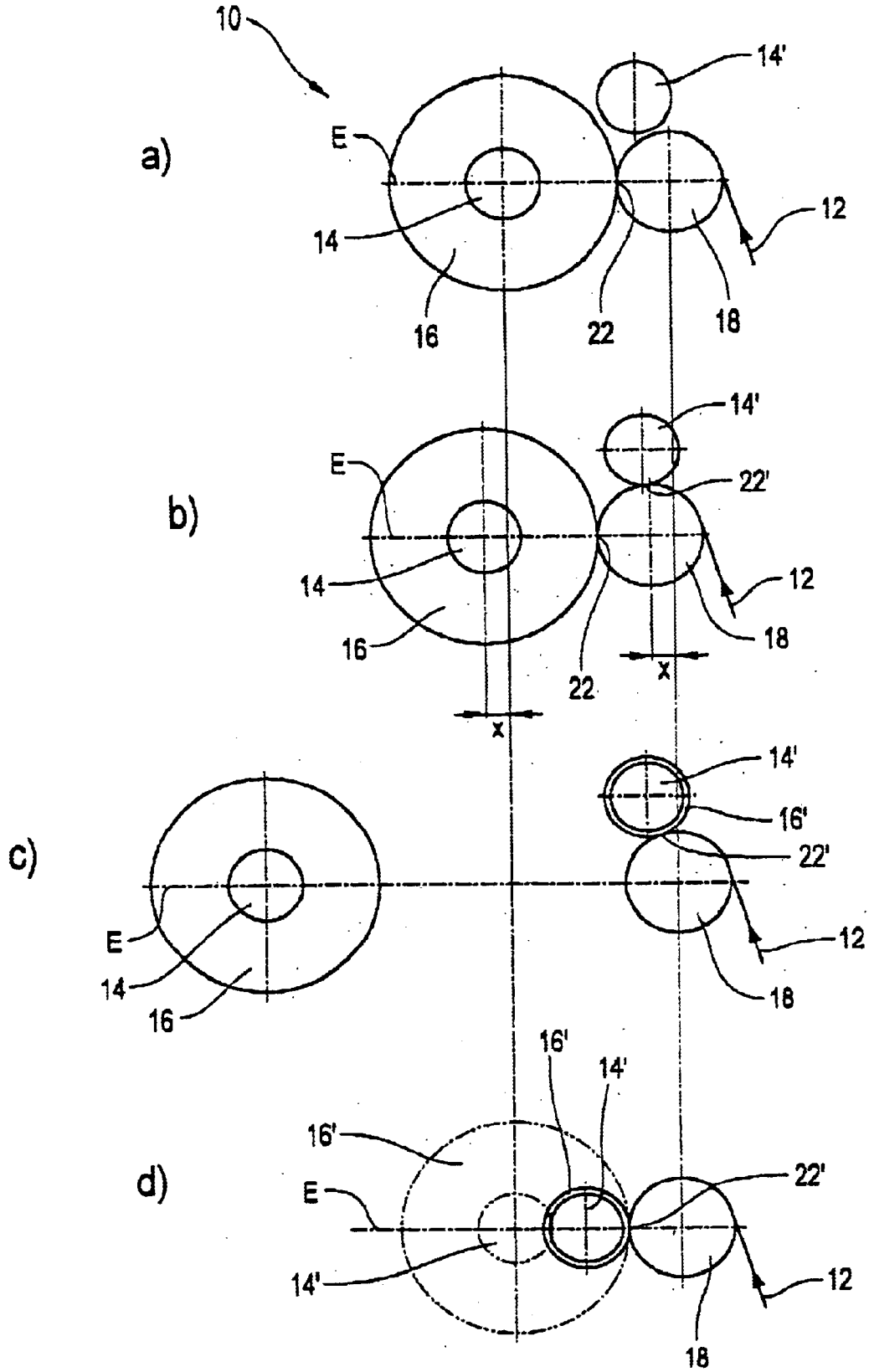
FIG. 1 illustrates four different winding phases of a winding machine.

FIG. 1 shows in a purely diagrammatic representation a diagrammatic sketch of a winding machine 10 for winding a material web 12 on a reel spool 14 forming an (old) wound reel 16. Material web 12 can be in particular a paper or cardboard web.

Material web 12 is guided over a reeling drum 18 that can be displaced preferably horizontally in place E. However, reeling drum 18 can also be movable along an inclined plane, such as is described in the printed publication WO 98/52858, the closure of which is expressly incorporated by reference herein in its entirety.

Figure 2:
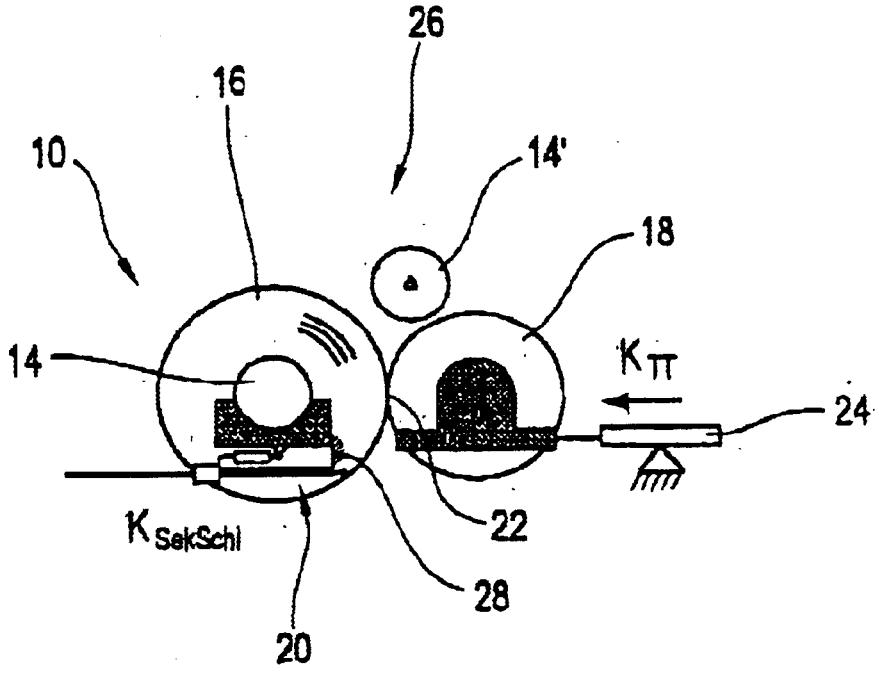
FIG. 2 illustrates a detailed representation of winding phase 1*a*), in which, although a new reel spool has been brought into a stand-by position, the new winding nip is not yet closed.

In the winding phase 1*a*) displaceable reeling drum 18 forms a winding nip 22 with old wound reel 16, which is displaceable by a secondary transport device 20 (see, e.g. FIG. 2). In this winding phase 1*a*) the linear load in winding nip 22 is adjusted, controlled or regulated by a corresponding displacement and tightening of reeling drum 18. The devices for adjustment, control and regulation are well known to one killed in the art and therefore do not require further representation in the Figures or further explanation in the present description of the Figures. The increase in diameter of old wound reel 16, which is displaceable by secondary transport device 20 is compensated for by a corresponding displacement of old wound reel 16.

A new reel spool 14' is already in a stand-by position at an oblique angle above reeling drum 18. However, the new winding nip between new reel spool 14' and reeling drum 18 is not yet closed here.

A path and power control is consequently provided in the winding phase 1*a*) regarding old wound reel 16, whereby the power control can be integrated into the path control. The increase in diameter in old wound reel 16 is compensated for by the path control. The linear load in winding nip 22 is adjusted, controlled or regulated by a corresponding displacement and tightening of reeling drum 18.

When a preset wound reel diameter is reached, reeling drum 18 is displaced jointly with wound reel 16, e.g., horizontally in the plane E to prepare for a turn-up, in order to close a winding nip 22' to be formed between reeling drum 18 and new reel spool 14' brought into a stand-by position (see winding phase 1*b*)).

During the joint displacement of reeling drum 18 and old wound reel 16 occurring during the winding phase 1*b*), old winding nip 22 formed with old wound reel 16 is maintained, so that temporarily two winding nips 22 and 22' are formed at the same time. The linear load in old winding nip 22 is thereby preferably adjusted, controlled or regulated by a corresponding displacement and tightening of old wound reel 16. For the control or regulation of the linear load, regarding old wound reel 16, e.g., a power control with a lift of approx. 50 to approx. 400 mm, preferably approx. 80 to approx. 120 mm, can be provided.

New reel spool 14' brought into a stand-by position at an oblique angle above reeling drum 18 in its horizontal sliding path (see also again winding phase 1*a*)) is pressed onto reeling drum 18 during the production of new winding nip 22' through the horizontal displacement of reeling drum 18 such that a preset linear load is established in new winding nip 22'.

In the winding phase 1*b*) reeling drum 18 and old wound reel 16 are thus jointly moved until the winding nip between reeling drum 18 and new reel spool 14' is closed. The linear load in old winding nip 22 is hereby adjusted, controlled or regulated by a corresponding displacement and tightening of old wound reel 16.

As soon as new winding nip 22' to be formed between reeling drum 18 and new reel spool 14' is closed, the web change takes place. Material web 12 is thereby separated by a web separator device and wound up with the new web leader on new reel spool 14'.

The corresponding power-controlled transport paths are marked by an x in the winding phase 1*b*) represented in FIG. 1.

Old wound reel 16 is removed from reeling drum 18 (see winding phase 1*c*)) while abolishing (or opening) old winding nip 22. New reel spool 14' is wound on and displaced, preferably swiveled, downwards by a primary transport device 26 while maintaining new winding nip 22' until it can be taken over by secondary transport device 20 (see FIGS. 2 and 3).

Primary transport device 26 can comprise, e.g., mandrels, by which new reel spool 14' can be correspondingly displaced or swivelled downwards, which rules out an interlacing with old wound reel 16.

The increase in diameter of new wound reel 16' occurring during the displacement of new reel spool 14' by the primary transport device is compensated for by corresponding, preferably horizontal, displacement of reeling drum 18. The linear load in new winding nip 22' is at least essentially stabilized during the displacement or swivelling of new reel spool 14'.

In the winding phase 1*c*) new reel spool 14' is thus wound on, and the displacement of new reel spool 14' downwards into a secondary position (see winding phase 1*d*) is begun. The increase in diameter of new wound reel 16' is compensated for by a preferably horizontal displacement of reeling drum 18. The linear load in new winding nip 22' remains constant during the displacement or during the swivelling of new reel spool 14'.

Figure 3:
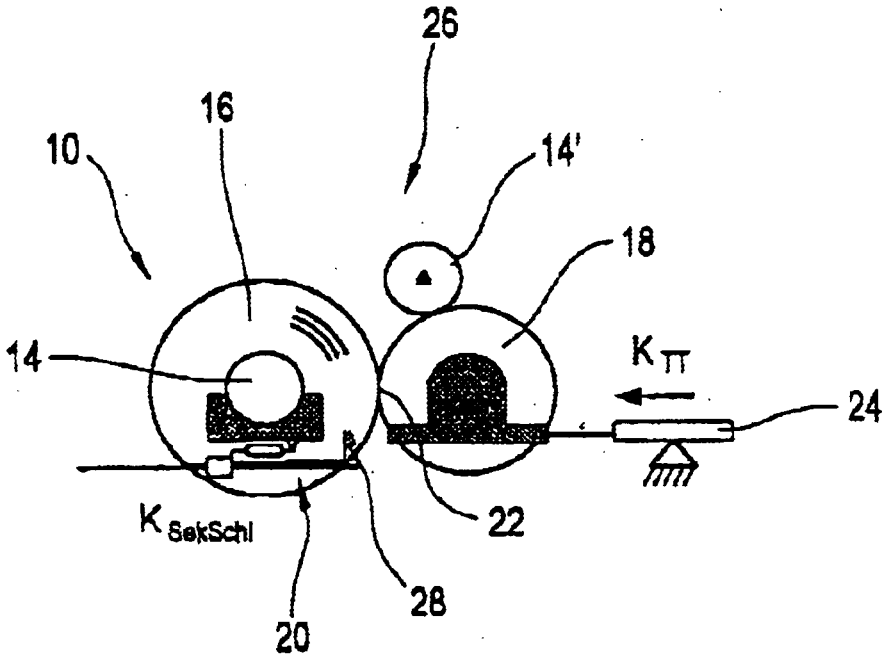
FIG. 3 illustrates a detailed representation of a winding phase in which two winding nips are formed at the same time.

In the wending phase 1*d*) new reel spool 14' adopts its secondary position, in which it can be taken over by secondary transport device 20 (see in particular also FIG. 3). The pressure in the integrated power control is greater than the linear load in new winding nip 22', which means that this linear load, as in the winding phase 1*a*), can again be adjusted, controlled or regulated by reeling drum 18. The reeling drum 18 is therefore power-controlled again in this winding phase 1*d*) just as in the corresponding winding phase 1*a*), whereas new wound reel 16' is only path-controlled.

FIG. 2 shows once again in a more detailed representation the winding phase 1*a*) of FIG. 1, whereby corresponding parts have been assigned the same reference numbers.

As can be seen from this FIG. 2, secondary transport device 20 comprises a secondary carriage that in the represented winding phase fits closely against a diagrammatically represented stop 28, which can be, e.g., a mechanical stop attached to the secondary device or an end stop of a cylinder. Reeling drum 18 is correspondingly acted upon by at least one control element 24 for controlling or regulating the linear load in winding nip 22.

The force $K_{SekSchl}$ with which the secondary carriage is acted upon is noticeably larger than the force $K_{TT}$ with which reeling drum 18 is acted upon.

FIG. 3 shows a more detailed representation of a winding phase in which two winding nips are formed at the same time, i.e., new winding nip 22' is already closed and old winding nip 22 still exists. The phase shown here is therefore comparable to the winding phase 1*b*) of FIG. 1. This is therefore again a phase in which a turn-up or web change is prepared. The force $K_{TT}$ is thereby greater than the force $K_{SekSchl}$. The linear load in old winding nip 22 is thus adjusted, controlled or regulated here by a corresponding displacement and tightening of old wound reel 16. New winding nip 22' is already closed here, as mentioned above.

It is further provided that the forces $K_{TT}$, $K_{SekSchl}$ can be controlled or regulated by at least one pressure control by corresponding control elements, such as, e.g., control element 24 acting on reeling drum 18, on the reeling drum and/or on the secondary transport device, preferably using Servo-p-Q proportional valves and/or pressure proportional valves. Such components and assemblies are part of the known prior art.

The generation of the forces $K_{TT}$, $K_{SekSchl}$ can take place, e.g., by a linear load force control which preferably features at least one load cell, and/or by mechanical, hydraulic, pneumatic or electrical components, whereby the components themselves are again part of the known prior art.

Figure 4:
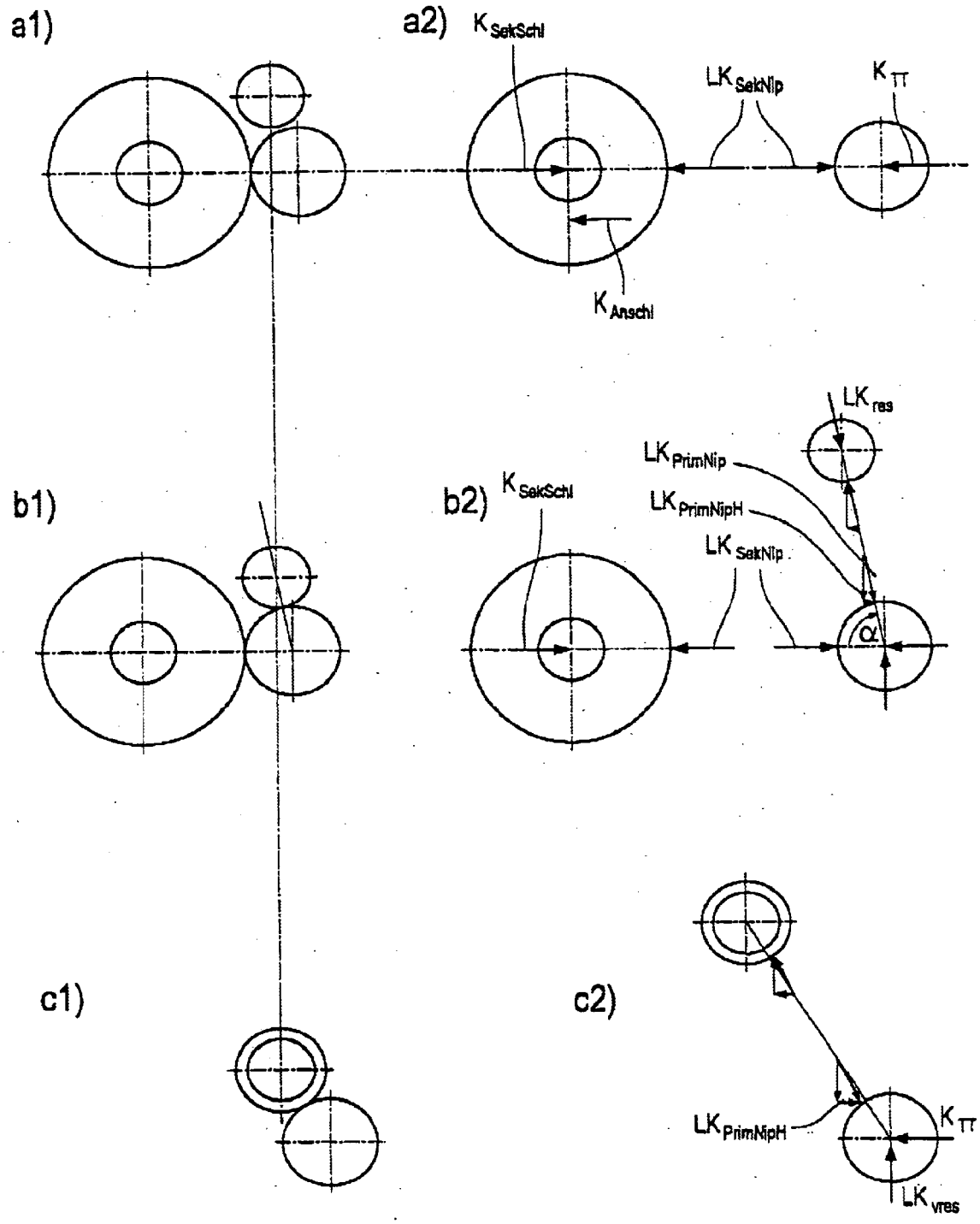
FIG. 4 illustrates three selected winding phases in free-cut force diagrams.

FIG. 4 shows a purely diagrammatic representation of three selected winding phases in free-cut diagrams of forces, whereby the winding phases a1), b1) and c1) represent the winding phases of FIGS. 1*a*), 1*b*) and 1*c*) in line section. FIGS. 4*a*2), 4*b*2) and 4*c*2) represent respectively the free-cut diagrams of forces, whereby the representation and consideration of any possible moments were completely omitted.

The winding phase a2) shows the winding phase represented and explained in FIG. 1*a*) in a free-cut diagram of forces. In general the following force relations apply in this main winding phase:

$$K_{SekSchl} >> K_{TT},$$

$$K_{Anschl} = K_{SekSchl} - LK_{SekNip} \cdot \text{web width},$$

and $$LK_{SekNip} \cdot \text{web width} = K_{TT}.$$

In the production of the so-called "two-nip operation" $K_{Anschl}$ preferably=0 and the wound reel and the reeling drum are accelerated with an acceleration of $a=(K_{TT}-K_{SekSchl})/(\text{width-related mass})$. In the case of too great an acceleration, the volume flow in the system can be limited in a known manner.

The winding phase b2) shows the winding phase represented and explained in FIG. 1*b*) in a free-cut diagram of forces. In general the following force relations apply in this "two-nip operation:"

$$LK_{SekNip} \cdot \text{web width} = K_{SekSchl},$$

$$LK_{PrimNipH} \cdot \text{web width} = K_{TT} - K_{SekSchl},$$

and $$LK_{PrimNip} = LK_{PrimNipH}/\cos(\alpha)$$

In the subsequent transition to the, "one-nip operation," i.e., during the opening of the secondary nip, the force $K_{TT}$ must be reduced by the amount $K_{SekSchl}$ so that no increase in force is generated.

The winding phase shows the winding phase c2) represented and explained in FIG. 1*c*) in a free-cut diagram of forces. In general the following force relations apply in this "winding in the primary area:"

$$LK_{PrimNipH} \cdot \text{web width} = K_{TT},$$

and $$LK_{PrimNip} = LK_{PrimNipH}/\cos(\alpha)$$

Figure 5:
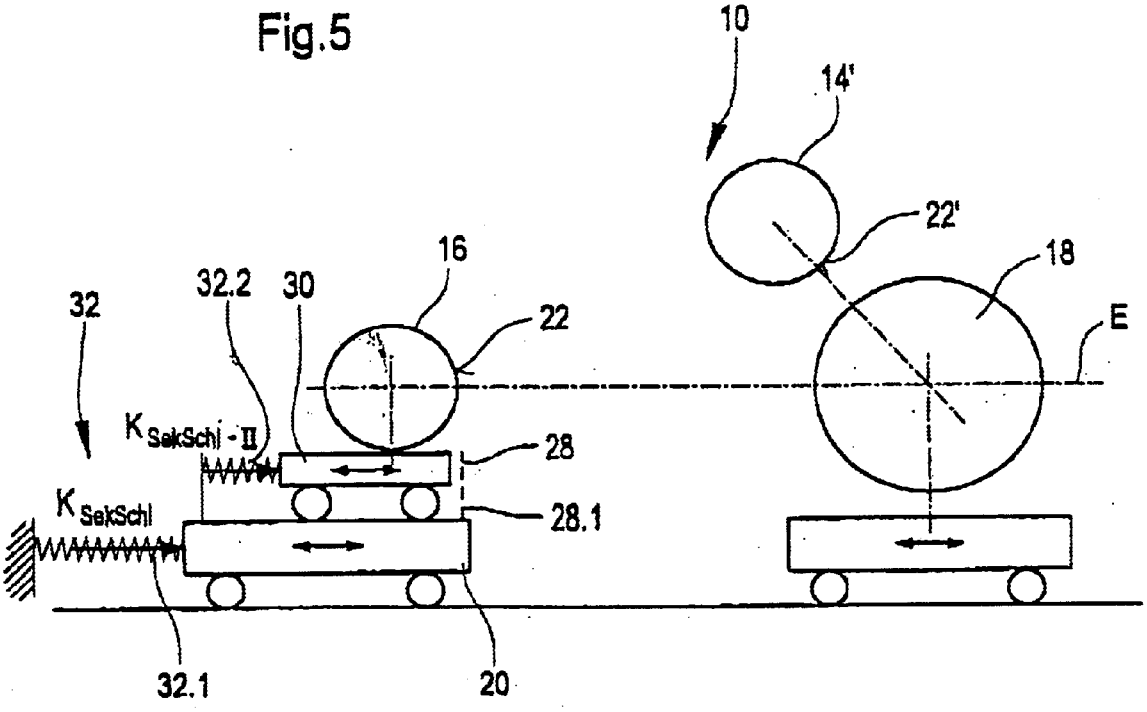
FIG. 5 illustrates a winding machine in accordance with an embodiment of the instant invention.

Finally, FIG. 5 shows a purely. diagrammatic representation of a diagrammatic sketch of a winding machine 10 according to an embodiment according to the invention, whereby the functional groups of the winding machine 10 that are relevant according to the invention are shown spatially separated from one another.

Winding machine 10 comprises a reeling drum 18 that can be displaced preferably horizontally in the plane E, but can also be movable along an inclined planes as described, e.g., in the printed publication WO 98/52858. The displaceability of the reeling drum is indicated by a double-ended directional arrow.

Winding machine 10 further comprises a secondary transport device 20 that indirectly supports a displaceable old wound reel 16 and which during the main winding phase forms a winding nip with the displaceable reeling drum 18 as shown, e.g., in FIG. 1. A displaceable movement device 30 is mounted on secondary transport device 20, which movement device actually directly supports displaceable old wound reel 16. The respective displaceability of secondary transport device 20 and movement device 30 is indicated by a respective double-ended directional arrow.

Both secondary transport device 20 and movement device 30 are acted on by a pressure system 32 that comprises a first pressure unit 32.1, which in terms of force acts on secondary transport device 20, and a second pressure unit 32.2, which in terms of force acts on the movement unit 30. Second pressure unit 32.2 is supported on secondary transport device 20. Pressure units 32.1 and 32.2 are preferably mechanical, hydraulic, pneumatic or electrical components. However, other types of components are also possible. It has proven useful in practice, e.g., if first pressure unit 32.1 is a mandrel drive and the second pressure unit 32.2 is a hydraulic unit comprising at least one hydraulic cylinder, or likewise a mandrel drive. Such pressure units 32.1 and 32.2 are well known to one skilled in the art and therefore do not require any further representation in the Figures or any further explanation in the present description of the Figures.

A stationary stop 28 is mounted on secondary transport device 20. In FIG. 5 the stationary stop is embodied as a mechanical stop 28.1. An end stop of a cylinder, preferably the hydraulic cylinder of second pressure unit 32.2, for instance, can also form stationary stop 28.

The process-related function of winding machine 10 during the so-called turn-up is explained in further detail below:

To close a new winding nip 22' between reeling drum 18 and a new reel spool 14' brought into a stand-by position, reeling drum 18 and old wound reel 16 are displaced jointly while maintaining old winding nip 22 between reeling drum 18 and old wound reel 16. After the closing of new winding nip 22' between reeling drum 18 and new reel spool 14', linear load $LK_{PrimNip}$ (see FIG. **4*b*2)) in new winding nip 22' is adjusted, controlled or regulated by a corresponding displacement and tightening of reeling drum 18**.

During the joint displacement of reeling drum 18 and old wound reel 16, the linear load $LK_{SekNip}$ (see FIG. **4*b*2) in old winding nip 22 is adjusted, controlled or regulated by a corresponding displacement and tightening of old wound reel 16**.

In order to effect the joint displacement of reeling drum 18 and old wound reel 16 while maintaining old winding nip 22 formed, in principle two possibilities can be used:

Reeling drum 18 is acted on by a force $K_{TT}$ generating linear load $LK_{SekNip}$, which force is greater than a force $K_{SekSchl}$ acting on old wound reel 16;

Old wound reel 16 is acted on by a pressure system 32 generating linear load $LK_{SekNip}$, which pressure system features at least two pressure units 32.1 and 32.2 preferably separate from one another, whereby each of these pressure units 32.1 and 32.2 can be acted on by a respective force $K_{SekSchl}$, $K_{SekSchl\text{-}II}$ to generate the linear load. In this manner, old wound reel 16 is acted on by a force $K_{SekSchl}$ generating linear load $LK_{SekNip}$, which force is smaller that a force $K_{TT}$ acting on reeling drum 18, and/or old wound reel 16 is acted on by a force $K_{SekSchl\text{-}II}$ generating linear load $LK_{SekNip}$, which force is smaller than a force $K_{TT}$ acting on reeling drum 18.

The forces $K_{TT}$ and $K_{SekSchl}$ and the linear load $LK_{SekNip}$ are represented and described in FIG. **4*a*2). The increase in diameter of old wound reel 16 during the joint displacement of reeling drum 18 and old wound reel 16 while maintaining old winding nip 22 formed, is compensated for by a corresponding displacement of at least one pressure unit 32.1 and 32.2, Further process functions of winding machine 10** during the entire winding process can be explained in more detail as follows:

Old wound reel 16 supported by a displaceable movement device 30 acted on by second pressure unit 32.2 in displaceable secondary transport device 20 acted on by first pressure unit 32.1, is acted on by force $K_{SekSchl\text{-}II}$ during the main winding phase such that it is supported in a stationary manner in secondary transport device 20. This stationary support can be, e.g., the support on stationary stop 28 already described.

The force $K_{TT}$ acting on reeling drum 18 is limited to a maximum, adjustable limit value $K_{TTmax}$, whereby when new winding nip 22' between reeling drum 18 and new reel spool 14' is closed, force $K_{TT}$ acting on reeling drum 18 reaches the maximum adjustable limit value $K_{TTmax}$, and subsequently force $K_{TT}$ is divided vectorially to generate a linear load $LK_{PrimNip}$ in new winding nip 22'.

Winding machine 10 is adjusted, controlled or regulated by at least one pressure control on reeling drum 18 and/or on secondary transport device 20 (first pressure device 32.1) and/or on movement device 30 (second pressure device 32.2), preferably using Servo-p-Q proportional valves.

Forces $K_{TT}$, $K_{SekSchl}$ and $K_{SekSchl\text{-}II}$ themselves are generated, controlled or regulated by a linear load control that preferable features at least one load cell and/or are adjusted, controlled or regulated by the use of pressure proportional valves.

Otherwise, the winding machine can be embodied, e.g., as described in printed publication WO 98/52858.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Winding machine
12 Material web
14 Reel spool
14' New reel spool
16 Old wound reel
16' New wound reel
18 Reeling drum
20 Secondary transport device
22 Old winding nip
22' New winding nip
24 Control element F (plane)
26 Primary transport device
28, 28.1 Stop
30 Movement device
32 Pressure system
32.1 First pressure unit
32.2 Second pressure unit
a Acceleration
α Angle
$K_{SekSchl}$ Force (secondary carriage)
$K_{SekSchl\text{-}II}$ Force (on old wound reel)
$K_{TT}$ Force (reeling drum)
$K_{Anschl}$ Force (stop)
$LK_{SekNip}$ Linear load (secondary nip)

$LK_{PrimNip}$ Linear load (primary nip)

$LK_{PrimNipH}$ Linear load (primary nip horizontal)

xPower-controlled transport path

What is claimed:

1. A process for winding a continuous material web on a reel spool forming a wound reel, comprising:

forming a winding nip between a displaceable reeling drum and an old wound reel, which is displaceably mounted in a secondary transport device;

adjusting, controlling or regulating a linear load ($LK_{SekNip}$) in the winding nip by a corresponding displacement and tightening of the reeling drum;

guiding the material web over the displaceable reeling drum that, with the old wound reel displaceable by a secondary transport device, forms a winding nip;

bringing a new reel spool into a stand-by position;

jointly moving the reeling drum and the old wound reel while maintaining the winding nip formed between the reeling drum and the old wound reel when the old wound reel attains a preset diameter whereby a new winding nip is formed between the new reel spool in the stand-by position and the reeling drum;

adjusting, controlling, or regulating a linear load ($LK_{PrimNip}$) in the new winding nip by a corresponding displacement and tightening of the reeling drum;

separating the material web by at least one separator device to form a new web leader;

winding the new web leader onto the new reel spool;

removing the old wound reel from the reeling drum, thereby opening the winding nip; and moving the new reel spool in a primary transport device while maintaining the new winding nip until the position of the new winding nip corresponds to the position where the winding nip was located.

2. The process in accordance with claim 1, wherein the material web comprises one of a paper or cardboard web.

3. The process in accordance with claim 1, wherein the moving of the new reel spool comprises moving the new reel spool over the reeling drum via the primary transport device until the new reel spool is taken over by the secondary transport device.

4. The process in accordance with claim 1, wherein the removing of the old wound reel comprises moving the old wound reel via the secondary transport device.

5. The process in accordance with claim 1, wherein during the joint displacement of the reeling drum and the old wound reel, the process further comprises adjusting, controlling, or regulating the linear load ($LK_{SekNip}$) in the old winding nip by a corresponding displacement and tightening of the old wound reel.

6. The process in accordance with claim 1, wherein the reeling drum is acted on by a force ($K_{TT}$) generating the linear load ($LK_{SekNip}$), and the force ($K_{TT}$) is greater than a force ($K_{SekSchl}$) acting on the old wound reel and causes the joint displacement of the reeling drum and the old wound reel while maintaining the old winding nip.

7. The process in accordance with claim 1, wherein the old wound reel is acted on by a pressure system generating the linear load ($LK_{SekNip}$) and the pressure system comprises at least two pressure units arranged such that each of the pressure units are acted on by a respective force ($K_{SekSchl}$, $K_{SekSchl\text{-}II}$) to generate the linear load ($LK_{SekNip}$).

8. The process in accordance with claim 7, wherein the at least two pressure units are independent of one another.

9. The process in accordance with claim 7, wherein the old wound reel is acted on by a force ($K_{SekSchl}$) generating the linear load ($LK_{SekNip}$), and the force ($K_{SekSchl}$) is smaller than a force ($K_{TT}$) acting on the reeling drum and causes the joint displacement of the reeling drum and the old wound reel while maintaining the old winding nip.

10. The process in accordance with claim 7, wherein the old wound reel is acted on by a force ($K_{SekSchl\text{-}II}$) generating the linear load ($LK_{SekNip}$) and the force ($K_{SekSchl\text{-}II}$) is smaller than a force ($K_{TT}$) acting can the reeling drum and causes the joint displacement of the reeling drum and the old wound reel while maintaining the old winding nip.

11. The process in accordance with claim 7, wherein the diameter of the old wound reel increases during the joint displacement of the reeling drum and the old wound reel, while maintaining the old winding nip, is compensated for by a corresponding displacement of at least one pressure unit.

12. The process in accordance with claim 7, wherein the at least two pressure units comprises a first and second pressure unit, and wherein the old wound reel is supported by a displaceable movement device acted on by the second pressure unit in the secondary transport device, and the secondary transport device is acted on by the first pressure unit, and the old wound reel is acted on by the force ($K_{SekSchl\text{-}II}$) during a main winding phase in which it is supported in the secondary transport device in a stationary manner.

13. The process in accordance with claim 1, wherein a force ($K_{TT}$) acting on the reeling drum is limited by a maximum, adjustable limit value ($K_{TTmax}$).

14. The process in accordance with claim 13, wherein, when the new winding nip between the reeling drum and the new reel spool is closed, the force ($K_{TT}$) acting on the reeling drum reaches the a maximum adjustable limit value ($K_{TTmax}$) and, subsequently, the force ($K_{TT}$) is vectorially divided to generate a linear load ($LK_{PrimNip}$) in the new winding nip.

15. The process in accordance with claim 14, wherein the forces ($K_{TT}$, $K_{SekSchl}$, $K_{SekSchl\text{-}II}$) are generated at least one of hydraulically and pneumatically and the forces are adjusted, controlled or regulated by at least one pressure control on at least one of the reeling drum, the secondary transport device, and the movement device.

16. The process in accordance with claim 15, wherein the at least one pressure control comprises Servo-p-Q proportional valves.

17. The process in accordance with claim 13, wherein the forces ($K_{TT}$, $K_{SekSchl}$, $K_{SekSchl\text{-}II}$) are generated, controlled or regulated by at least one linear load control that comprises at least one load cell.

18. The process in accordance with claim 13, wherein the forces ($K_{TT}$, $K_{SekSchl}$, $K_{SekSchl\text{-}II}$) are adjusted, controlled or regulated by pressure proportional valves.

19. The process in accordance with claim 13, wherein the forces ($K_{TT}$, $K_{SekSchl}$, $K_{SekSchl\text{-}II}$) are generated by mechanical, hydraulic, pneumatic or electrical components.

20. The process in accordance with claim 1, wherein an increase in diameter of the old wound reel is compensated for during a main winding phase by a corresponding displacement of the old wound reel.

21. The process in accordance with claim 1, wherein to control or regulate the linear load ($LK_{SekNip}$) in the old winding nip during a main winding phase by the corresponding displacement and tightening of the old wound reel during the joint displacement of the reeling drum and the old wound reel, a power control lifts the old winding reel between about 50–400 mm.

22. The process in accordance with claim 21, wherein the power control lifts the old wound reel between about 80–120 mm.

23. The process in accordance with claim 1, wherein the new reel spool is moved from a higher position to a lower position by the primary transport device.

24. The process in accordance with claim 23, wherein the primary transport device swivelably moves the new reel spool.

25. The process in accordance with claim 1, wherein the primary transport device comprises mandrels, and the new reel spool is displaced or swivelled by the mandrels.

26. The process in accordance with claim 1, wherein the old wound reel is displaced at least essentially horizontally by the secondary transport device.

27. The process in accordance with claim 1, wherein the secondary transport device comprises mandrels and the old wound reel is displaced by the mandrels.

28. The process in accordance with claim 1, wherein the reeling drum is displaced horizontally.

29. The process in accordance with claim 1, wherein the stand-by position is located at an oblique angle above the reeling drum, and when the new winding nip is closed, reeling drum is pressed against the new reel spool in the stand-by position by a horizontally moving the reeling drum so that a preset linear load ($LK_{PrimNip}$) is established in the new winding nip.

30. The process in accordance with claim 1, wherein the increasing diameter of the new wound reel occurring during the displacement of the new reel spool by the primary transport device is compensated for by a corresponding, displacement of the reeling drum.

31. The process in accordance with claim 1, wherein linear load ($LK_{PrimNip}$) in the new winding nip is stabilized at least essentially during the displacement of the new reel spool by the primary transport device.

32. The process in accordance with claim 1, wherein a direction of the joint movement of the reeling drum and the old wound reel has at least one directional component in the direction of movement of the secondary transport device.

33. A winding machine for the continuous winding of a material web on a reel spool forming a wound reel, comprising:

a displaceable reeling drum having a circumferential area structured to receive the material web;

a secondary transport device structured and arranged to displace an old wound reel;

said reeling drum and the old wound reel being arranged to form a winding nip and a linear load ($LK_{SekNip}$) in said winding nip is controlled or regulated by a corresponding displacement and tightening of, said reeling drum;

a device locating a new reel spool into a stand-by position, wherein, when a preset wound reel diameter is attained, said reeling drum and the old wound reel are structured and arranged to jointly move toward said stand-by position, while maintaining the winding nip, to form a new winding nip between the new reel spool and said reeling drum;

at least one web separating device is structured and arranged to separate the material web and to form a new web leader;

said secondary transport device is movable to open the winding nip and to move said old wound reel away from said reeling drum;

a primary transport device is structured and arranged to move the new reel spool from the stand-by position to a position at which the winding nip was located while maintaining the new winding nip;

wherein a linear load ($LK_{PrimNip}$) in the new winding nip is adjustable, controllable or regulatable by a corresponding displacement and tightening of the reeling drum.

34. The winding machine in accordance with claim 33, wherein the material web comprises one of a paper or cardboard web.

35. The winding machine in accordance with claim 33, wherein the primary transport device is structured and arranged to move the new reel spool over the reeling drum until it is taken over by the secondary transport device.

36. The winding machine in accordance with claim 33, wherein, during the joint displacement of the reeling drum and the old wound reel, the linear load ($LK_{SekNiP}$) in the old winding nip is adjustable, controllable, or regulatable by a corresponding displacement and tightening of the old wound reel.

37. The winding machine in accordance with claim 33, further comprising at least one pressure unit, wherein an increasing diameter of the old wound reel in joint movement with said reeling drum is compensated by a corresponding displacement of said least one pressure unit.

38. The winding machine in accordance with claim 33, wherein said reeling drum is acted on by a force ($K_{TT}$) and the old wound reel is acted on by a pressure system that features at least two pressure units, such that each of the pressure units are acted on by a respective force ($K_{SekSchl}$, $K_{SekSchl\text{-}II}$) to generate the linear load ($LK_{SekNip}$).

39. The winding machine in accordance with claim 38, wherein said at least two pressure units are independent of each other.

40. The winding machine in accordance with claim 38, wherein respective forces ($K_{TT}$, $K_{SekSchl}$, $K_{SekSchl\text{-}II}$) are adjustable, controllable, or regulatable by at least one pressure control on at least one of said reeling drum, said secondary transport device, and said movement device.

41. The winding machine in accordance with claim 40, wherein said at least one pressure control comprises Servo-p-Q proportional valves.

42. The winding machine in accordance with claim 33, farther comprising at least one linear load control having at least one load cell structured and arranged to adjust, control or regulate the forces ($K_{TT}$, $K_{SekSchl}$, $K_{SekSchl\text{-}II}$).

43. The winding machine in accordance with claim 33, wherein the forces ($K_{TT}$, $K_{SekSchl}$, $K_{SekSchl\text{-}II}$) are adjustable, controllable, or regulatable by using pressure proportional valves.

44. The winding machine in accordance with claim 33, wherein mechanical, hydraulic, pneumatic or electrical components generate the forces ($K_{TT}$, $K_{SekSchl}$, $K_{SekSchl\text{-}II}$).

45. The winding machine in accordance with claim 33, wherein the force ($K_{TT}$) acting on the reeling drum is adjustable, controllable, or regulatable via pressure proportional valves.

46. The winding machine in accordance with claim 33, wherein the increasing diameter of the old wound reel is compensated during a main winding phase by a corresponding displacement of the, old wound reel.

47. The winding machine in accordance with claim 33, wherein, to control or regulate the linear load ($LK_{SekNip}$) in the old winding nip by a corresponding displacement and tightening of the old wound reel during the joint movement of the reeling drum and the old wound reel, a power control is structured and arranged to provide a lift of between about 50–400 mm.

48. The winding machine in accordance with claim 47, wherein said power control is structured and arranged to provide a lift of between about 80–120 mm.

49. The winding machine in accordance with claim 33, wherein the new reel spool is displaceable in said primary transport device from a higher position to a lower position.

50. The winding machine in accordance with claim 49, wherein said primary transport device is arranged to swivelably move the new reel spool around said reeling drum.

51. The winding machine in accordance with claim 33, wherein said primary transport device comprises mandrels and the new reel spool is displaceable or swivelled by said mandrels.

52. The winding machine in accordance with claim 33, wherein the old wound reel is displaceable at least essentially horizontally by said secondary transport device.

53. The winding machine in accordance with claim 33, wherein said secondary transport device comprises mandrels and the old wound reel is displaceable by said mandrels.

54. The winding machine in accordance with claim 33, wherein said reeling drum is horizontally displaceable.

55. The winding machine in accordance with claim 33, wherein said standby position is located at an oblique angle above said reeling drum, and when the new winding nip is closed, reeling drum is pressed against the new reel spool in the stand-by position by a horizontally moving the reeling drum so that a preset linear load ($LK_{PrimNip}$) is established in the new winding nip.

56. The winding machine in accordance with claim 33, wherein the increasing diameter of the new wound reel occurring during the movement of the new reel spool by said primary transport device is compensated for by a corresponding, displacement of said reeling drum.

57. The winding machine in accordance with claim 33, wherein linear load ($LK_{PrimNip}$) in the new winding nip is stabilized at least essentially during the displacement of the new reel spool by said primary transport device.

* * * * *